US009079420B2

(12) United States Patent
Tsuji

(10) Patent No.: US 9,079,420 B2
(45) Date of Patent: Jul. 14, 2015

(54) PRINTING CONTROL DEVICE AND PRINTING IMAGE CONTROL METHOD

(71) Applicant: SEIKO EPSON CORPORATION, Tokyo (JP)

(72) Inventor: Hiroyuki Tsuji, Matsumoto-shi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 44 days.

(21) Appl. No.: 13/774,102

(22) Filed: Feb. 22, 2013

(65) Prior Publication Data

US 2013/0278660 A1 Oct. 24, 2013

(30) Foreign Application Priority Data

Apr. 19, 2012 (JP) ..... 2012-095293

(51) Int. Cl.
*B41J 29/38* (2006.01)
*B41J 2/21* (2006.01)

(52) U.S. Cl.
CPC ..... *B41J 2/2132* (2013.01); *B41J 2/2117* (2013.01)

(58) Field of Classification Search
CPC .... B41J 2/0458; B41J 2/04563; B41J 29/393; B41J 2/04591; B41J 2/04581
USPC ..... 347/14
See application file for complete search history.

(56) References Cited

U.S. PATENT DOCUMENTS

| | | | | |
|---|---|---|---|---|
| 7,407,277 | B2 | 8/2008 | Yoneyama | |
| 2004/0004643 | A1* | 1/2004 | Satomura | 347/9 |
| 2005/0237352 | A1 | 10/2005 | Yoneyama | |
| 2009/0244137 | A1* | 10/2009 | Kakutani | 347/12 |
| 2010/0203824 | A1* | 8/2010 | Chang et al. | 455/3.06 |
| 2011/0221805 | A1* | 9/2011 | Yoshida et al. | 347/9 |
| 2011/0234660 | A1* | 9/2011 | Yoshida | 347/9 |

FOREIGN PATENT DOCUMENTS

| | | | |
|---|---|---|---|
| JP | 08-108574 | A | 4/1996 |
| WO | 2005/105452 | A1 | 11/2005 |

* cited by examiner

*Primary Examiner* — Manish S Shah
*Assistant Examiner* — Yaovi Ameh
(74) *Attorney, Agent, or Firm* — Maschoff Brennan

(57) ABSTRACT

Provided is a printer for forming an image layer in which the effect of a background image is reduced when a color image layer representing an image and a background image layer superimposed onto the color image layer are printed on a printing medium. The printer includes a control circuit which performs control to cause ink to be discharged from at least one of a first nozzle group and a second nozzle group, on the basis of both first ink level data indicating ink quantity created by color-converting first image data for forming a color image layer representing an image, and second ink level data indicating ink quantity created by color-converting second image data that forms a background image layer superimposed onto the color image layer and has a data format that is different from the data format of the first image data.

7 Claims, 10 Drawing Sheets

PRINTING CONTROL DEVICE AND PRINTING IMAGE CONTROL METHOD

CROSS-REFERENCE TO RELATED APPLICATION

The entire disclosure of Japanese Patent Application No. 2012-095293, filed Apr. 19, 2012 is expressly incorporated by reference hereby.

BACKGROUND

1. Technical Field

The present invention relates to a printing control device for printing, on a printing medium, a color image layer representing an image and a background image layer which is superimposed onto the color image layer.

2. Related Art

A known example of this type of printing control device is a device in which nozzles for discharging ink are divided into a plurality of nozzle groups and ink is discharged from each nozzle group as a printing medium moves (as described in WO 2005/105452). Specifically, in this device, printing is carried out by using nozzles including a row of nozzles which discharge color ink for recording a color image and a row of nozzles which discharge special ink for recording a background image and by moving the nozzles in a main scanning direction with respect to the printing medium, and also by discharging ink from the nozzles onto the printing medium while moving the printing medium in a sub-scanning direction with respect to the nozzles. Furthermore, the nozzles are divided into a first nozzle group which is arranged at an upstream side where printing is first carried out and a second nozzle group which is arranged at a downstream side and being adjacent to the first nozzle group, and ink is discharged from the nozzle rows of each nozzle group when the printing medium is moved in the sub-scanning direction with respect to the nozzles. For example, special ink is discharged from the nozzle rows of the first nozzle group to form a background image, and after a recording medium on which the background image has been formed is transported in the sub-scanning direction, color ink for forming a color image layer is discharged from the nozzle rows of the second nozzle group in the portion in which the background image is formed. Printed material in which a color image layer is formed on a background image layer on a printing medium, can thus be obtained.

However, with this kind of printed material, when printing is carried out by arranging the background image layer and color image layer on top of each other, there are problems in that specific colors are not distinct and there is an increase in the amount of ink because the characteristics of the color ink in each layer are not taken into account.

SUMMARY

An advantage of some aspects of the invention is that when a color image layer which represents an image and a background image which is superimposed onto the color image layer are printed on a printing medium, it is possible to form image layers in which the effect of the background image is reduced.

The invention can be implemented in the following forms or application examples.

APPLICATION EXAMPLE 1

Application Example 1 is a printer for printing on a printing medium by moving a printing head (250), which discharges ink from a nozzle, in a relative manner with respect to the printing medium in a main scanning direction and a sub-scanning direction which intersects the main scanning direction, the printer including: a first image data setting unit (112) for setting first image data (D1) for forming a color image layer representing an image; a second image data setting unit (114) for setting second image data (D2) which forms a background image layer that is superimposed onto the color image layer and has a data format that is different from the data format of the first image data (D1); and a control unit which receives the first and second image data (D1, D2) from the first and second image data setting units (112, 114) and creates ink level data that indicates an amount of ink to be discharged from a nozzle of the printing head (250), wherein the control unit creates first ink level data indicating ink quantity by color-converting the first image data (D1) from the first image data setting unit (112), creates second ink level data indicating ink quantity by color-converting the second image data (D2) from the second image data setting unit (114), and causes at least one of nozzle groups of the printing head (250) that includes a first nozzle group (250F), which prints first at an upstream side, and a second nozzle group (250S), which is adjacent to the first nozzle group (250F) and prints at a downstream side, to discharge ink from the first and second nozzle groups (250F, 250S) on the basis of both the first and second ink level data.

The control unit in the printer according to Application Example 1 creates the ink level data on the basis of the first image data which is set by the first image data setting unit and is for forming the color image layer, and on the basis of the second image data which is set by the second image data setting unit, forms the background image layer that is superimposed onto the color image layer, and has a data format that is different from the data format of the first image data. Furthermore, because the control unit causes at least one of nozzle groups of the printing head that includes the first nozzle group, which prints first at the upstream side, and the second nozzle group, which is adjacent to the first nozzle group and prints at the downstream side, to discharge ink from the first and second nozzle groups on the basis of both the first and second ink level data, it is possible to obtain a variety of printed material that take into account ink color characteristics and ink quantity, etc. of the first image data and second image data.

APPLICATION EXAMPLE 2

Application Example 2 is a printer in which the first image data that is set by the first image data setting unit is RGB data, and the second image data that is set by the second image data setting unit is CMYK data.

APPLICATION EXAMPLE 3

Application Example 3 is a printer in which the printing head (250) includes: a plurality of color ink nozzle rows in which nozzles for discharging color ink capable of forming the color image layer are arranged in the sub-scanning direction; and a special ink nozzle row in which nozzles that discharge special ink capable of forming the background image layer are arranged parallel to the color ink nozzle rows.

APPLICATION EXAMPLE 4

Application Example 4 is a printer in which, when ink having the same color is discharged from each of the first nozzle group and the second nozzle group in the same region of the printing medium, the control unit controls these amounts of ink on the basis of a predetermined correlation.

APPLICATION EXAMPLE 5

Application Example 5 is a printer in which the control unit performs control on the basis of the predetermined correlation so as to reduce the amount of ink of the first or second nozzle group (250F, 250S).

APPLICATION EXAMPLE 6

Application Example 6 is a printer in which the special ink is white ink.

APPLICATION EXAMPLE 7

Application Example 7 is a printer in which the special ink is metallic ink.

APPLICATION EXAMPLE 8

Application Example 8 is a printer in which the control unit uses metallic ink as the special ink and performs control in such a way that the amount of white ink on the background image layer formed of the metallic ink is less than the amount of the white ink in a region in which the metallic ink is not present.

APPLICATION EXAMPLE 9

Application Example 9 is a printing method in which first image data for forming a color image layer representing an image and second image data which forms a background image layer that is superimposed onto the color image layer and has a data format that is different from the data format of the first image data are used to create ink level data that indicates an amount of ink discharged from a nozzle of a printing head, the printing image control method including: processing to create first ink level data indicating ink quantity, by color-converting the first image data; processing to create second ink level data indicating ink quantity, by color-converting the second image data; and processing to cause at least one of nozzle groups of the printing head that includes a first nozzle group, which prints first at an upstream side, and a second nozzle group, which is adjacent to the first nozzle group and prints at a downstream side, to discharge ink from the first and second nozzle groups on the basis of both the first and second ink level data.

BRIEF DESCRIPTION OF THE DRAWINGS

The invention will be described with reference to the accompanying drawings, wherein like numbers reference like elements.

DESCRIPTION OF EXEMPLARY EMBODIMENTS (1) Schematic Configuration of a Printing System 10

Figure 1:
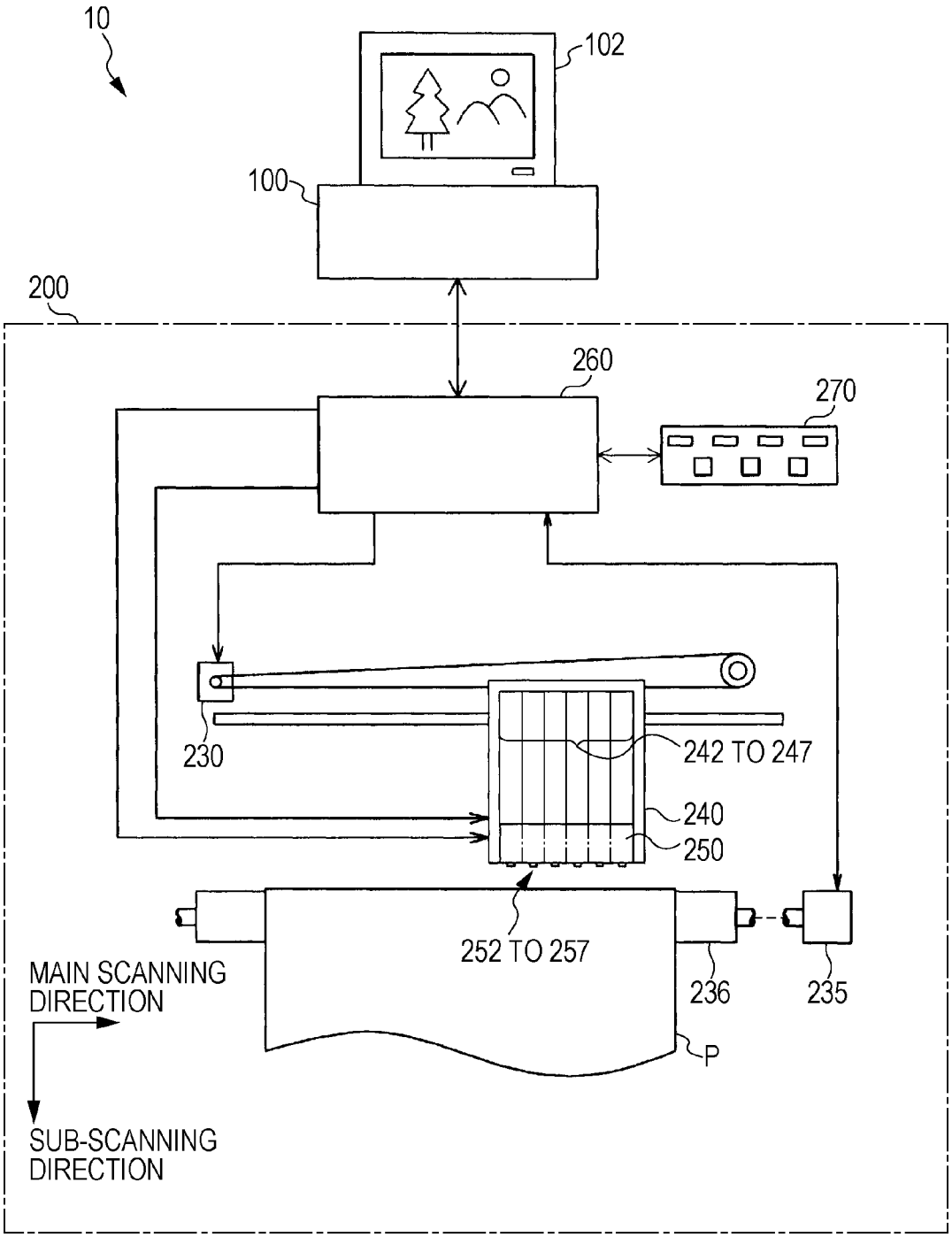
FIG. 1 is a schematic configuration diagram of a printing system according to an embodiment of the invention.

FIG. 1 is a schematic configuration diagram of a printing system 10 according to an embodiment of the invention. As shown in the diagram, the printing system 10 includes, among other components, a computer 100 and a printer 200 which in practice prints an image under the control of the computer 100. The entire printing system 10 as a single unit functions as a printing device in the broad sense.

(2) Configuration of the Computer 100

The computer 100 is a commonly-known computer which is configured by connecting a CPU and other components such as ROM and RAM together by means of a bus. A predetermined operating system is installed in the computer 100, and an application program operates under this operating system. A printer driver is integrated in the operating system. When image data to be printed is acquired, the printer driver operates to thereby control the printer 200 and print the image data.

(3) Configuration of the Printer

The printer 200 is configured from: a mechanism for transporting a printing medium P in a sub-scanning direction on a platen 236 by means of a paper feed motor 235; a mechanism for moving a carriage 240 reciprocally in the axial direction of the platen 236 (main scanning direction) by means of a carriage motor 230; a mechanism for driving a printing head 250 mounted in the carriage 240, to discharge ink and form dots; and a control circuit 260 for controlling the exchange of signals between the paper feed motor 235, carriage motor 230, printing head 250, and an operation panel 270.

(3)-1 Configuration of the Carriage 240 and Ink Cartridges

The carriage 240 has mounted therein: color ink cartridges 242 to 245 which respectively accommodate cyan ink C, magenta ink M, yellow ink Y, and black ink K as color ink; and special ink cartridges 246 and 247 which respectively accommodate metallic ink Mt and white ink Wh. Six types of nozzle rows 252 to 257 corresponding to the aforementioned color inks and special inks of each color are formed in the printing head 250 in the lower section of the carriage 240. When the ink cartridges 242 to 247 are mounted in the carriage 240 from above, it is possible to supply ink from each cartridge to the nozzle rows 252 to 257.

It should be noted that the meaning of "color ink" in the application also includes black ink. The color inks are dye inks in the embodiment, but the color ink type is not particularly limited and the color inks may also be, for example, pigment inks Furthermore, in the embodiment, from among the color inks, the cyan ink C, magenta ink M, and yellow ink Y with which colors are rendered by means of subtractive color mixing are referred to as the "three primary color inks", and inks other than the three primary color inks, namely metallic ink and white ink, are referred to as "special inks" The metallic ink is an ink which imparts a metallic effect to printed material, and for this kind of metallic ink, it is possible to use, for example, an oil-based ink composition including a metal pigment for imparting a metallic effect, an organic solvent, and a resin. This kind of metal pigment can be formed from aluminum or an aluminum alloy, and it is also possible for the metal pigment to be made by crushing a metal deposition film.

(3)-2 Details of the Printing Head 250

Figure 2:
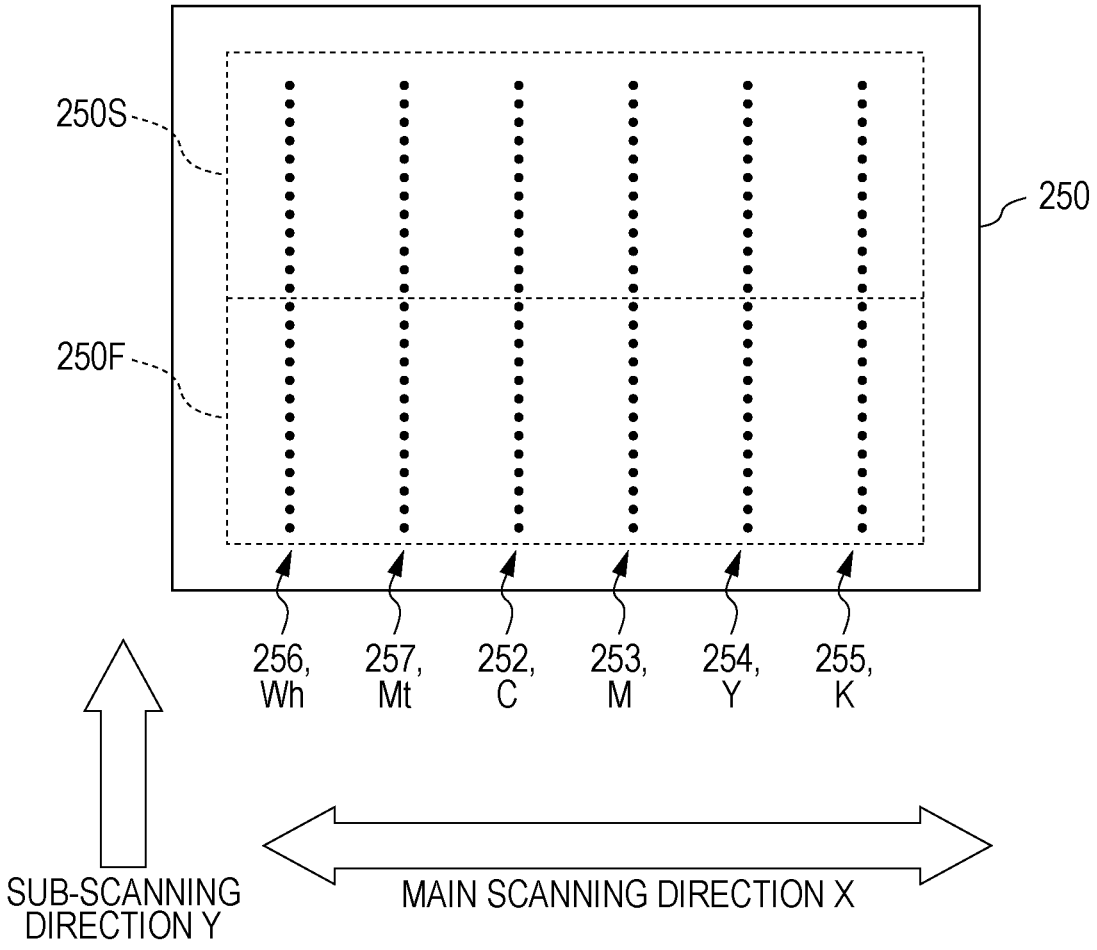
FIG. 2 is an illustrative diagram showing a printing head.

FIG. 2 is an illustrative diagram showing the printing head 250, where the bottom surface (surface facing the printing medium P) of the printing head 250 is shown schematically. As shown in the diagram, the printing head 250 includes the nozzle rows 252 to 257 which are formed by a plurality of nozzles being arranged in rows in a sub-scanning direction Y. In the embodiment, each nozzle row is formed from 180 nozzles. These nozzle rows 252 to 257 discharge cyan ink C, magenta ink M, yellow ink Y, black ink K, white ink Wh, and metallic ink Mt, respectively, in accordance with the ink colors of the cartridges mounted in the carriage 240. It should be noted that, in the embodiment, the nozzle row corresponding to each ink color is formed by nozzles being arranged in a single row, but the arrangement of the nozzles in a single nozzle row is not particularly limited and, for example, may be implemented in such a way that nozzles are arranged in a plurality of rows and the nozzles of the plurality of rows are arranged in a staggered manner. As is described hereafter, the nozzle rows 252 to 257 are implemented in such a way that they are divided into a plurality of rows in a main scanning direction X perpendicular to the sub-scanning direction Y and discharge ink. For example, in FIG. 2, the nozzle rows 252 to 257 are implemented in such a way that they are divided into an upstream-side first nozzle group 250F and a downstream-side second nozzle group 250S in the sub-scanning direction and are able to discharge ink.

(3)-3 Configuration of the Control Circuit 260 of the Printer 200

The control circuit 260 of the printer 200 shown in FIG. 1 is configured by connecting a CPU, ROM, RAM, PIF (peripheral equipment interface), and so on, together by means of a bus, and controls the main scanning operation and sub-scanning operation of the carriage 240 by controlling the operation of the carriage motor 230 and paper feed motor 235. Furthermore, when the control circuit 260 receives ink level data output from the computer 100, the control circuit 260 supplies a drive signal corresponding to the ink level data, to the printing head 250 in accordance with the main scanning or sub-scanning motion of the carriage 240, and is thereby able to drive the head for the colors. It should be noted that the control circuit 260 corresponds to the control unit in the claims.

The printer 200 having the aforementioned hardware configuration drives the carriage motor 230 to thereby move the printing head 250 (the nozzle rows 252 to 257 of each color) reciprocally in the main scanning direction with respect to the printing medium P, and also drives the paper feed motor 235 to thereby move the printing medium P in the sub-scanning direction. The control circuit 260 drives the nozzles at an appropriate timing on the basis of the ink level data and in accordance with the reciprocal motion (main scanning) of the carriage 240 and the paper-feeding motion (sub-scanning) of the printing medium, and thereby forms an ink dot of an appropriate color in an appropriate position on the printing medium P. As a result, it is possible for the printer 200 to print a color image on the printing medium P. Furthermore, with the printer 200, it is also possible to use, as the printing medium P, transparent printing media such as OHP film besides non-transparent printing media such as normal paper and card.

(4) Detailed Configuration of the Printing System 10

Figure 3:
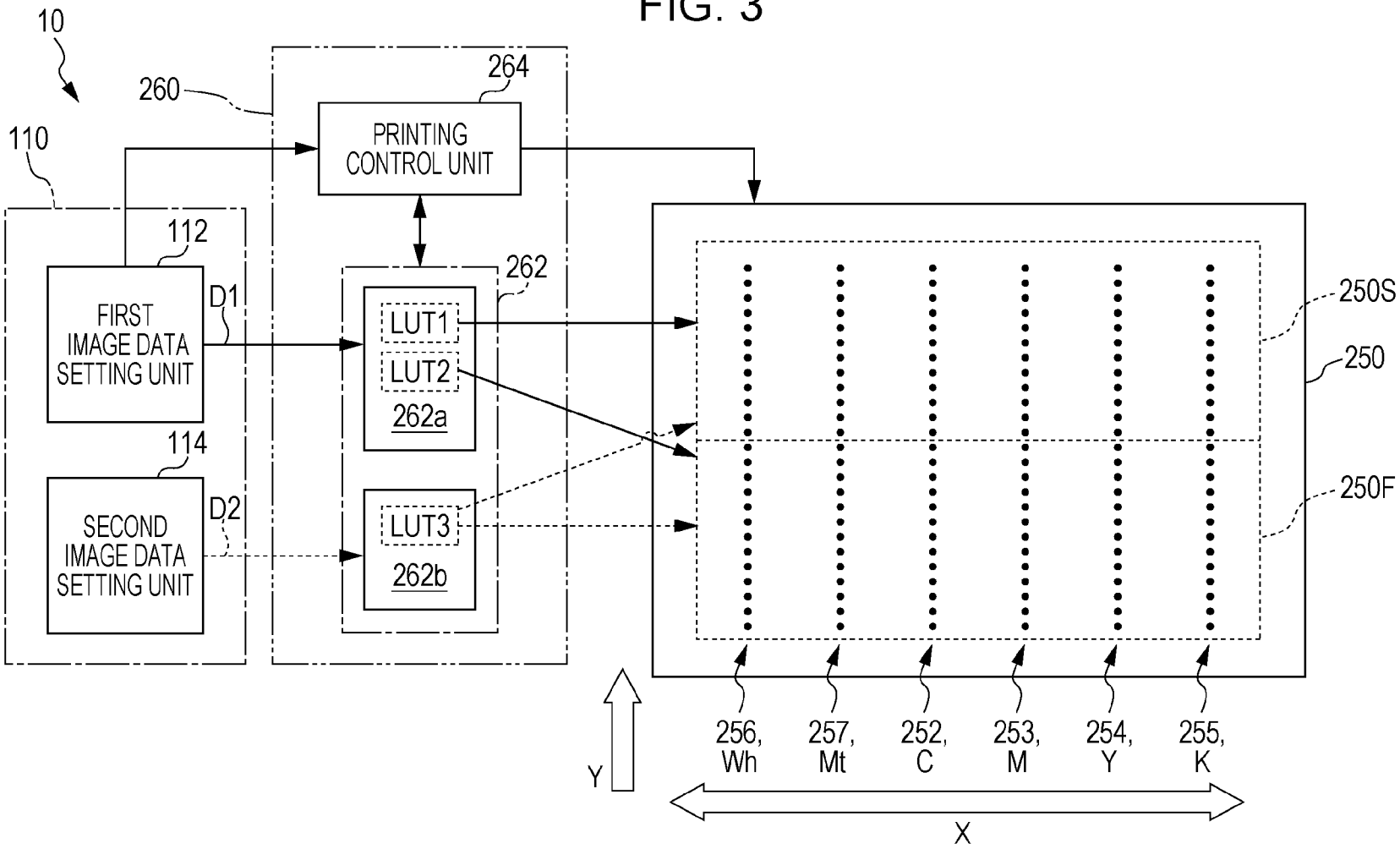
FIG. 3 is a block diagram for illustrating the configuration of the printing system.

FIG. 3 is a block diagram for illustrating the configuration of the printing system 10. The printing system 10 includes: an image data setting unit 110 which is mounted in the computer 100; a color conversion module 262, which is constituted by a program, etc. in the control circuit 260 of the printer 200; and a printing control unit 264 for controlling the color conversion module 262 and printing head 250.

(4)-1 Image Data Setting Unit 110

The image data setting unit 110 has functions which allow a user to set image data and a background image to be printed on a printing medium; that is, the image data setting unit 110 includes a first image data setting unit 112 and a second image data setting unit 114. The first image data setting unit 112 is an interface for setting first image data D1 which is created by the user by means of an image editing application, etc. The first image data D1 is, for example, data which forms a color space consisting of R, G, and B color components having 256 gradations, and which forms a color image layer.

The second image data setting unit 114 is an interface for setting second image data D2 which forms a background image layer that is superimposed onto the color image layer. The second image data D2 is data which can be created by the user by means of an image editing application, etc., and, for example, shows white density and color density in 256 CMYK-format gradations which can be visually perceived by the user. The second image data D2 has a data format which is different from the first image data D1 and constitutes image data of a color system that includes CMYK as the base colors. It should be noted that although the following description focuses on, as the background image layer, a white-based background in which white ink is used, it is possible for the embodiment to be implemented with the same configuration also in the case of a metal-based background using metallic ink Mt, etc.

Figure 4:
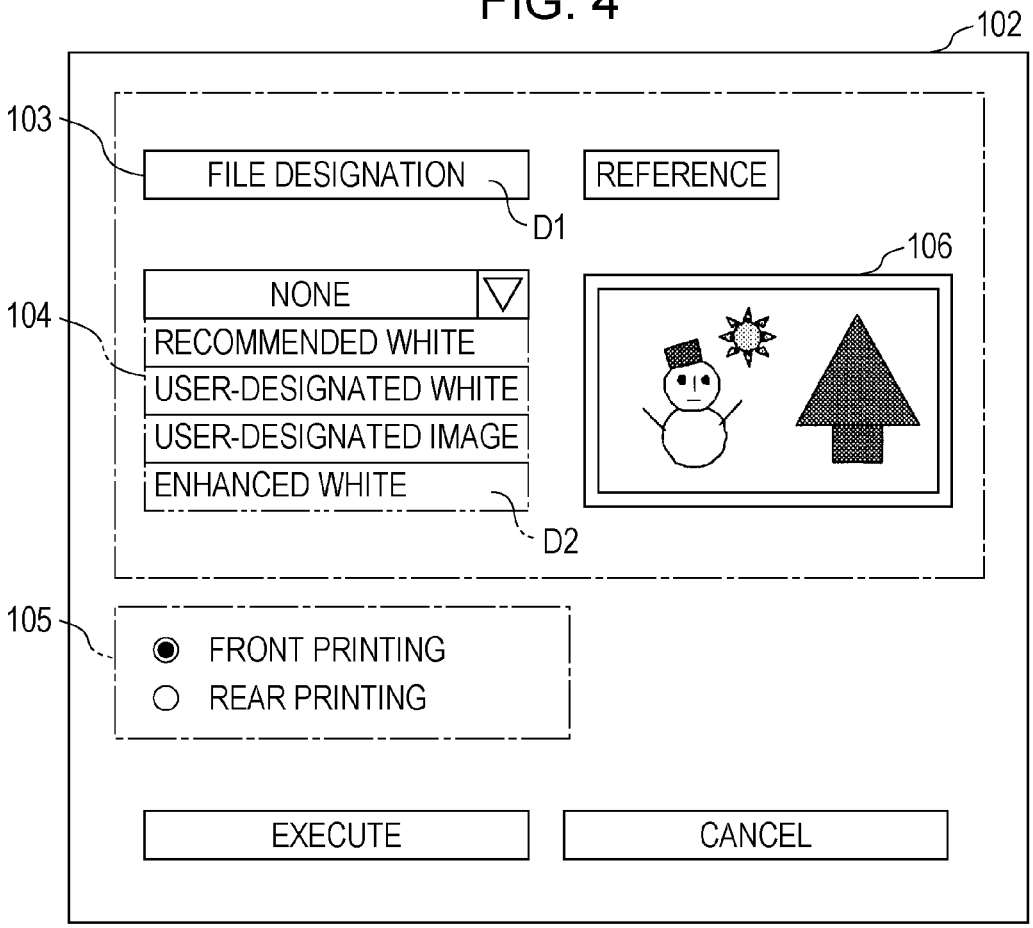
FIG. 4 is an illustrative diagram showing an input image on a computer display.

The first and second image data setting units 112 and 114 can set the first and second image data D1 and D2 by use of the interface shown in FIG. 4. FIG. 4 is an illustrative diagram showing an input screen menu on a display 102 of the computer 100. The menu is provided with a file designating section 103, background image setting section 104, and printing mode setting section 105. The file designating section 103 constitutes a command which makes it possible for the user to set an image file as the first image data D1. The background image setting section 104 constitutes a command which makes it possible to set the second image data D2 by selecting and designating an item from predetermined items (none, recommended white) by means of a pull-down menu. In this case, it is possible for the user to designate and thereby set a color background image as well as a white background image. The printing mode setting section 105 is a menu for selecting either one of front printing or rear printing. The front printing and rear printing modes will be described hereafter. A printing image which has been set by using this file designating section 103 and background image setting section 104 is displayed by a display unit 106.

(4)-2 Color Conversion Module 262

In FIG. 3, the color conversion module 262 includes a first color conversion unit 262*a* and a second color conversion unit 262*b*. The first color conversion unit 262*a*, in accordance with a pre-prepared first color conversion table LUT1, converts R, G, and B color component data of a color region of the first image data D1 into color components (cyan (C), magenta (M), yellow (Y), and black (B)) which can be rendered by the printer 200, and also sets the color ink quantity as ink level data. In other words, RGB values of each pixel making up the first image data D1 are each converted into CMYK values on the basis of the first color conversion table LUT1 to thereby create CMYK-format color ink level data. The first color conversion table LUT1 is a table for converting, for example, input data having 256 gradations in the RGB format into output data having 256 gradations in the CMYK format, and defines CMYK values corresponding to each RGB value.

Furthermore, the RGB values of each pixel making up the first image data D1 are converted into white ink level data Wh2 on the basis of a second white conversion table LUT2. The second white conversion table LUT2 is a table for converting input data having 256 gradations in the RGB format into output data having 256 gradations in the Wh format, and defines Wh values corresponding to each RGB value.

In this way, the RGB values of each pixel making up the first image data D1 are respectively converted into CMYK color ink level data or Wh2 white ink level data in accordance with the first and second color conversion tables LUT1 and LUT2.

The second color conversion unit 262*b*, in accordance with a pre-prepared third color conversion table LUT3, converts CMYK data of a background image region of the second image data D2 into color ink level data (C), etc. and white ink level data Wh1. The third color conversion table LUT3 is a one-dimensional table for converting input data indicating density values having 256 gradations into ink level data indicating the level amount of white ink and color ink having 256 gradations, and defines values corresponding to each density value.

The printing control unit 264 carries out data processing while synchronizing the color conversion module 262; that is, the data sequence of half-toned image data is reordered to a sequence for transfer to the printing head 250 and is output as ink level data. During this process, in accordance with the settings of the image data setting unit 110, the printing control unit 264 implements a normal printing mode in which all of the nozzle rows of the printing head 250 are used to form a single color image layer on the printing medium, and also implements, as special printing modes, a front printing mode and rear printing mode, etc. in which the nozzle rows of the printing head 250 are divided.

(5) Special Printing Modes of the Printing System

Figure 5:
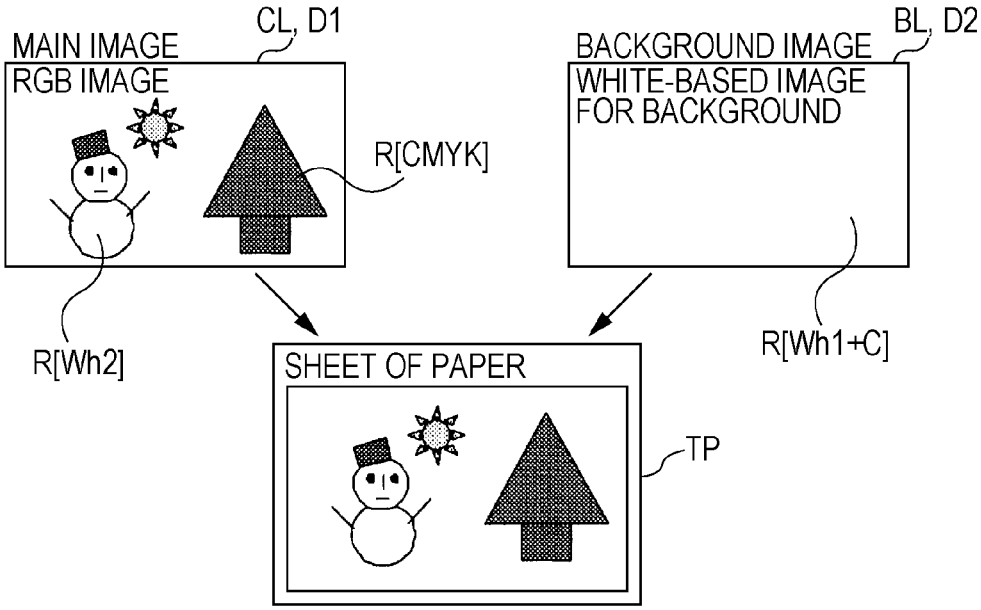
FIG. 5 is an illustrative diagram showing an image which has been printed by means of a front printing mode from among special printing modes.

FIG. 5 is an illustrative diagram showing an image which has been printed by means of the front printing mode from among the special printing modes.

(5)-1 Front Printing Mode

Figure 6:
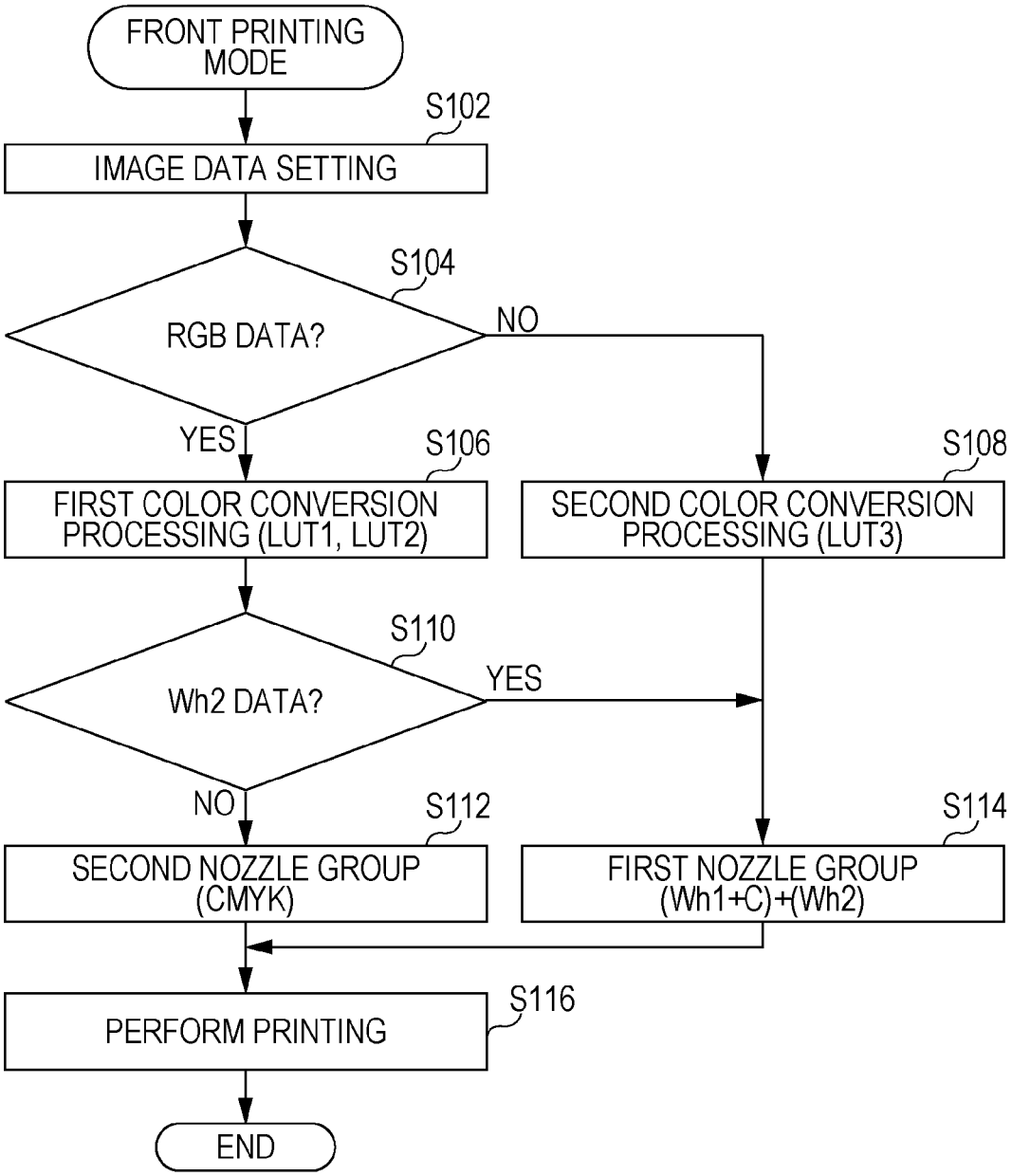
FIG. 6 is a flowchart describing the front printing mode.

The front printing mode is a mode with which a target image TP is obtained by second image data D2 being used to form a solid background image layer BL on the surface of a printing medium and first image data D1 being used to form a color image layer CL thereon. The image shown in FIG. 5 is described together with FIG. 3, FIG. 4 and the flowchart shown in FIG. 6 for the case in which the image is printed by means of the front printing mode. When a special printing mode is selected by the user, the input screen shown in FIG. 4 is displayed on the display 102. In FIG. 4, when the user selects an image file in the file designating section 103, first image data D1 which forms a color image layer is set, and, furthermore, when a background image layer is selected in the background image setting section 104, second image data D2 is set. Here, as shown in FIG. 5, a white-based background including cyan (C) as well as white (Wh1) is selected as the background image layer BL. Then, when the execution button is pressed after the front printing mode has been selected in the printing mode setting section 105 shown in FIG. 4, processing which is described in the flowchart shown in FIG. 6 is executed by the printing control unit 264.

First, in step S102, when the first and second image data D1 and D2 set by the image data setting unit 110 in FIG. 3 are acquired, in the following step S104, it is determined whether or not the first and second image data D1 and D2 are RGB data. When a positive determination is made in step S104, the process advances to step S106 and first color conversion processing is carried out. The first color conversion processing is the processing described with respect to the first color conversion unit 262*a* in FIG. 3, namely that RGB data of the first image data D1 is converted in accordance with the pre-prepared first color conversion table LUT1 into first ink level data indicating CMYK-format color ink level data. Furthermore, in the first color conversion processing, with respect to the first image data D1, the data of a region indicating a white image is converted on the basis of the second white conversion table LUT2 into first ink level data indicating white ink level data Wh2. More specifically, the RGB values of each pixel of the first image data D1 are converted into five sets of ink level data indicating C, M, Y, K, and Wh2, respectively, in accordance with the first and second color conversion tables LUT1 and LUT2.

However, when the image data is determined as not being RGB data in step S104, the process advances to step S108 and second color conversion processing is carried out. The second color conversion processing is the processing described with respect to the second color conversion unit 262*b* in FIG. 3, namely that CMYK data of the second image data D2 is converted in accordance with the pre-prepared third color conversion table LUT3 into second ink level data (Wh1 or C) indicating ink quantity.

In step S110, when one of the five sets of data indicating C, M, Y, K, and Wh2 following color conversion is determined as not being white ink level data Wh2, that is, when one of the aforementioned five sets of data is determined as being color ink level data, the process advances to step S112. In step S112, the CMYK nozzle rows of the second nozzle group 250S are set as nozzle rows to be used by the printing head 250 shown in FIG. 2. In step S114, however, the Wh and C nozzle rows of the first nozzle group 250F are set as nozzle rows to be used by the printing head 250, with regard to both the ink level data in relation to which the first image data D1 was determined as being white ink level data Wh2 by means of the determination made in step S110, and the ink level data of the second image data subjected to second color conversion processing in step S108. In the following step S116, printing is carried out on the printing medium by driving the printing head 250 in the main scanning direction and also moving the printing medium in the sub-scanning direction, and by discharging inks from the nozzle rows of the nozzle groups set in steps S112 and S114.

Figure 7A:
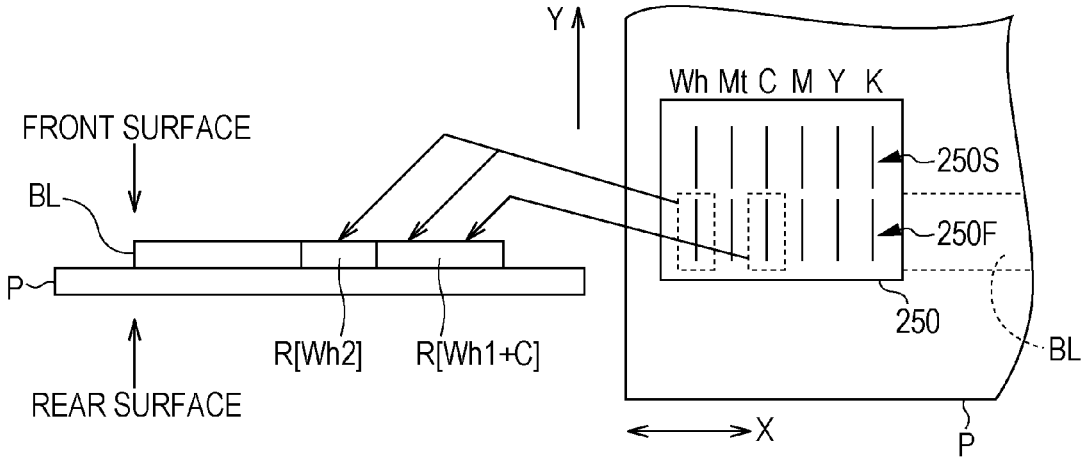
FIGS. 7A and 7B are illustrative diagrams showing the printing process of the front printing mode.
Figure 7B:
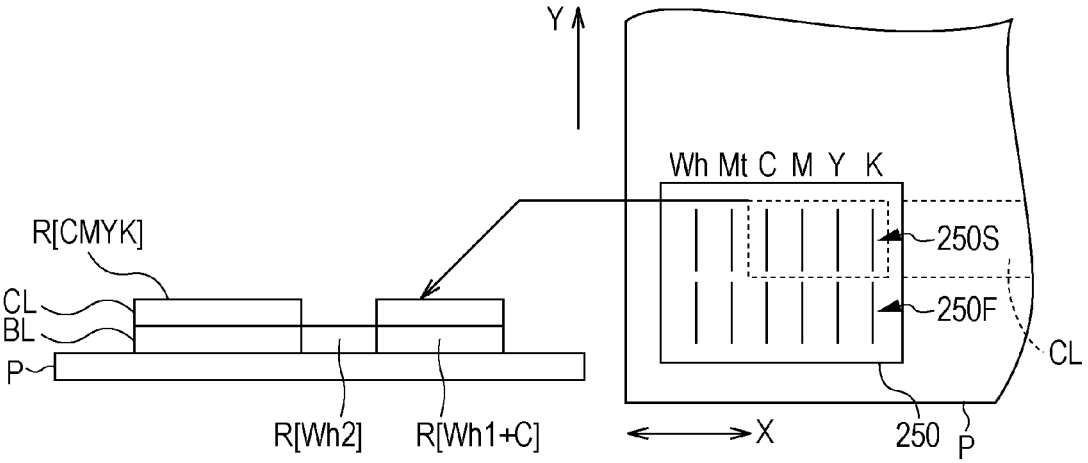

FIGS. 7A and 7B are illustrative diagrams showing the printing process of the front printing mode. FIG. 7A shows a process in which a background image layer BL is mainly printed, and FIG. 7B shows a process in which a color image layer CL is mainly printed. In FIG. 7A, white ink and cyan ink are discharged from nozzle row (Wh) and nozzle row (C) from among the upstream-side first nozzle group 250F of the printing head 250, and a background region R[Wh1+C] of the background image layer BL is printed on the printing medium P. At the same time as this, white ink is discharged from nozzle row (Wh) from among the first nozzle group 250F and a white region R[Wh2] forming a portion of the background image layer BL is printed on the printing medium P. During this process, the white region R[Wh2] of the first image data is formed on the printing medium P in a region which does not overlap with the background region R[Wh1+C]. As shown in FIG. 7B, the printing medium P intermittently moves in the sub-scanning direction by the length of a nozzle group, inks are discharged from nozzle rows (CMYK) from among the downstream-side second nozzle group 250S, and a color region R[CMYK] of the color image layer CL is printed on the printing medium P. During this process, the color region R[CMYK] is formed on the printing medium P in a region which does not overlap with the white region R[Wh2].

Figure 8:
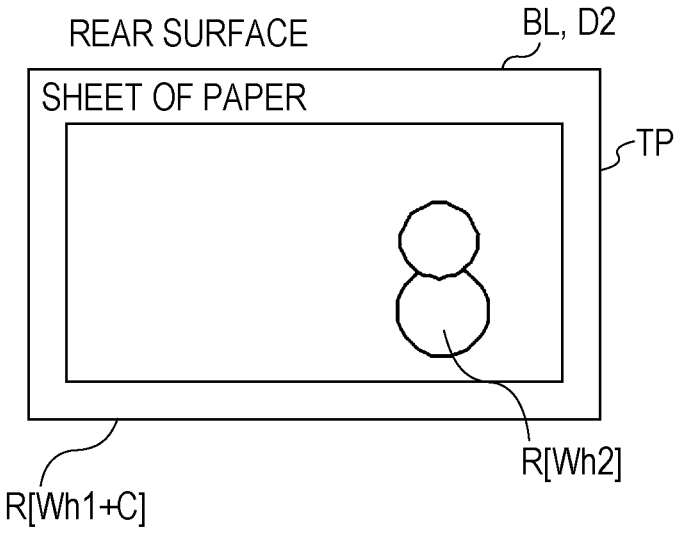
FIG. 8 is an illustrative diagram of a printing medium viewed from the rear surface.

FIG. 8 is an illustrative diagram of the printing medium P viewed from the rear surface. As shown in FIG. 8, the background region R[Wh1+C] and white region R[Wh2] can be seen on the rear surface of the printing medium P. In other words, the white region R[Wh2] extracted from the first image data is formed without overlapping the background region R[Wh1+C]. In this way, it is possible to obtain a distinct white image because the white region R[Wh2] does not overlap the background region R[Wh1+C] and is not affected by the colors of the background region R[Wh1+C].

Furthermore, although white ink is discharged in the white region R[Wh2], the amount of white ink can be reduced because white ink is not discharged in the background region R[Wh1+C].

(5)-2 Rear Printing Mode

Figure 9:
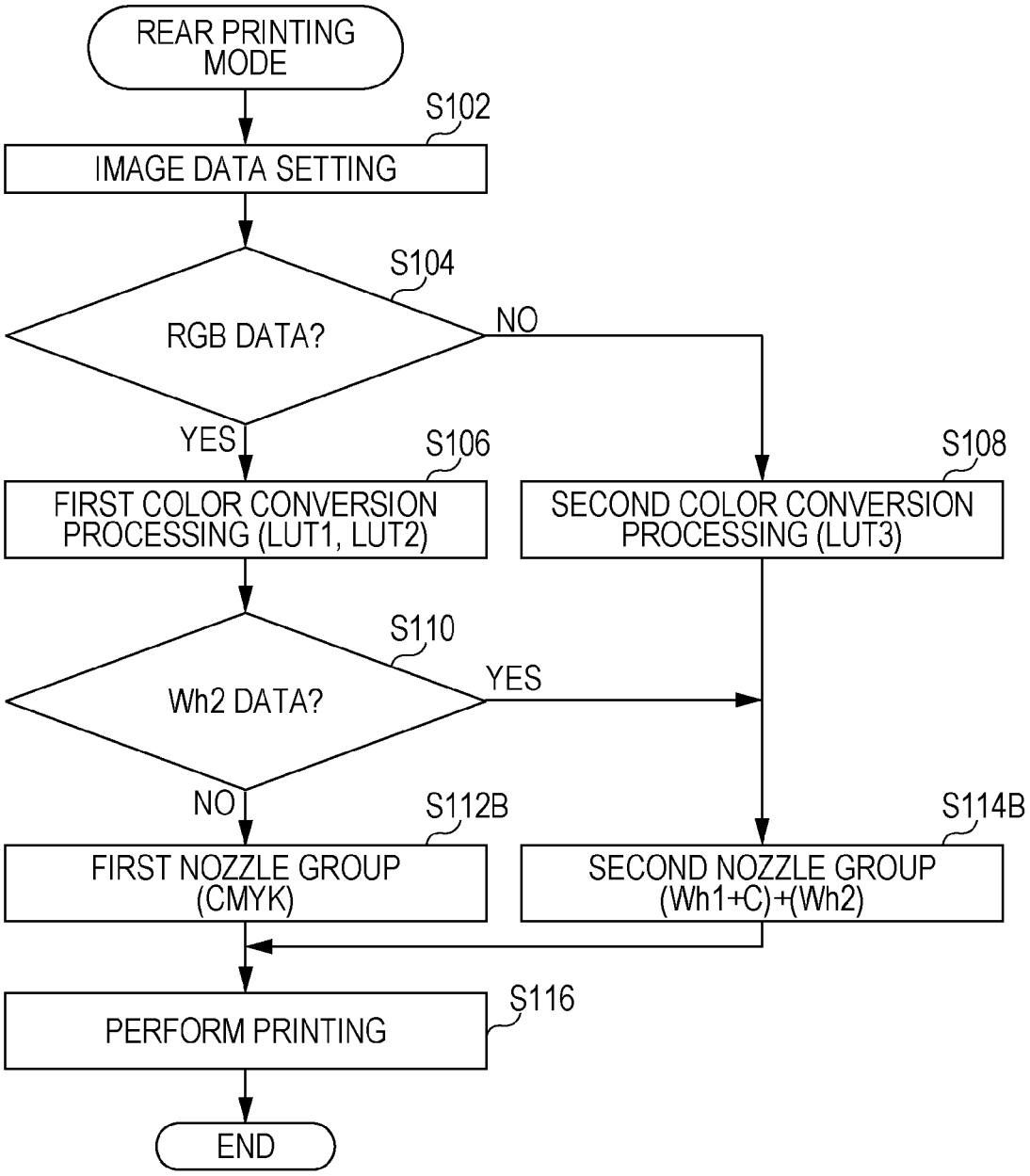
FIG. 9 is a flowchart describing a rear printing mode.

The rear printing mode is a mode with which a target image TP is obtained by the first image data being used to form a color image layer on the surface of a transparent or semi-transparent printing medium and the second image data being used to form a background image layer thereon. FIG. 9 is a flowchart describing the rear printing mode. This processing is almost the same as the front printing mode shown in FIG. 6, but step S112B and step S114B are different in order to change the printing order of the background image layer and color image layer. That is, as shown in FIG. 4, an image file is selected by means of the file designating section 103 and a background image layer is selected by means of the background image setting section 104, and when the execution button is pressed after the rear printing mode has been selected in the printing mode setting section 105, processing which is described in the flowchart of FIG. 9 is carried out by the printing control unit 264. More specifically, after processing for the first image data color conversion, etc. has been carried out, in step S112B the CMYK nozzle rows of the first nozzle group 250F are set as nozzle rows to be used by the printing head 250. However, after processing for the second image data color conversion, etc. has been carried out, in step S114B, the Wh and C nozzle rows of the second nozzle group 250S are set as nozzle rows to be used by the printing head 250. Then, in step S116, printing is carried out on the printing medium P by discharging inks from the nozzle rows of the nozzle groups set in steps S112B and S114B.

Figure 10A:
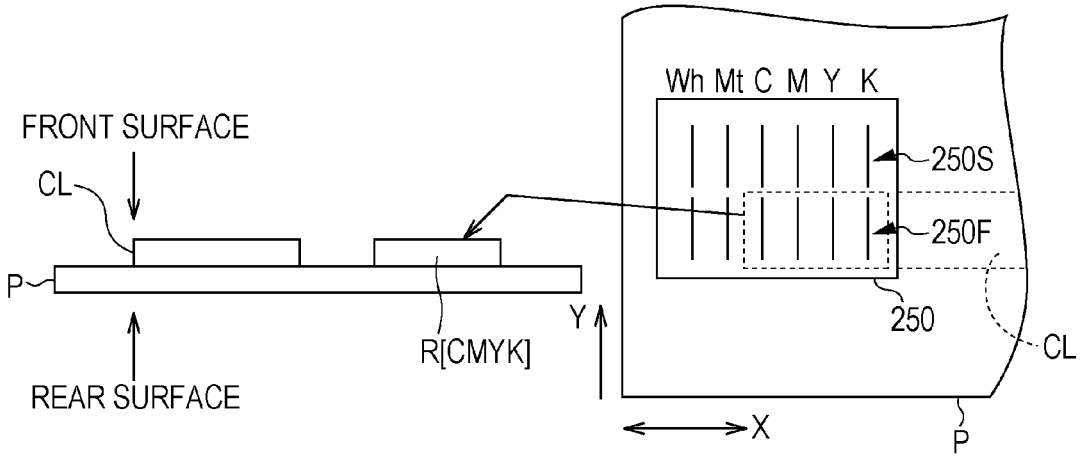
FIGS. 10A and 10B are illustrative diagrams showing the printing process of the rear printing mode.
Figure 10B:
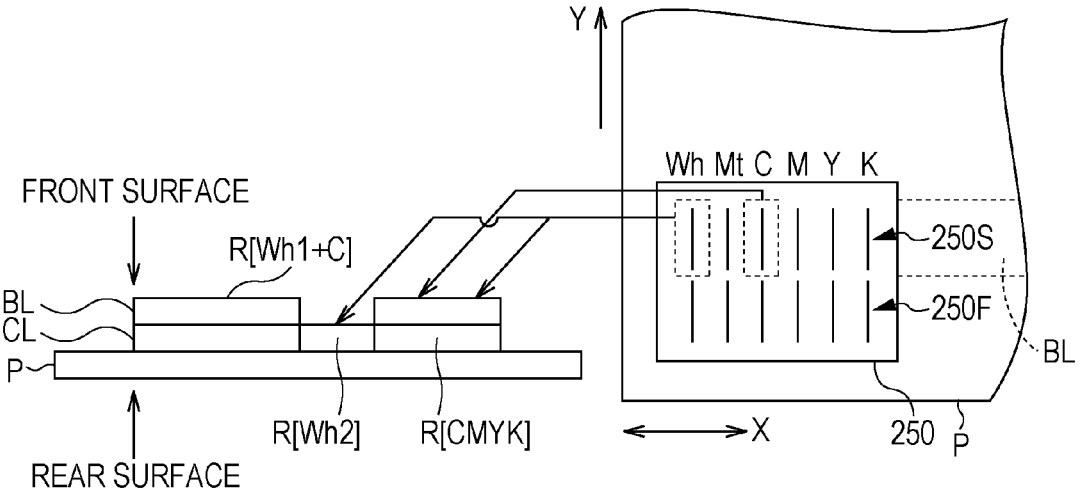

FIGS. 10A and 10B are illustrative diagrams showing the printing process of the rear printing mode, FIG. 10A shows a process in which a color image layer CL is mainly printed, and FIG. 10B shows a process in which a background image layer BL is mainly printed. In FIG. 10A, inks are discharged from nozzle rows (CMYK) from among the upstream-side first nozzle group 250F of the printing head 250, and a color region R[CMYK] of the color image layer CL is printed on the printing medium P. The white region R[Wh2] of the first image data is not formed on the printing medium P at this time. As shown in FIG. 10B, the printing medium P intermittently moves in the sub-scanning direction by the length of a nozzle group, white ink and cyan ink are discharged from the nozzle row (Wh) and the nozzle row (C) from among the downstream-side second nozzle group 250S, and a background region R[Wh1+C] of the background image layer BL is printed on the printing medium P. At the same time as this, white ink is discharged from nozzle row (Wh) from among the second nozzle group 250S and a white region R[Wh2] forming a portion of the color image layer CL is printed on the printing medium P. During this process, the white region R[Wh2] of the first image data is formed on the printing medium P in a region which does not overlap with the background region R[Wh1+C].

Figure 11:
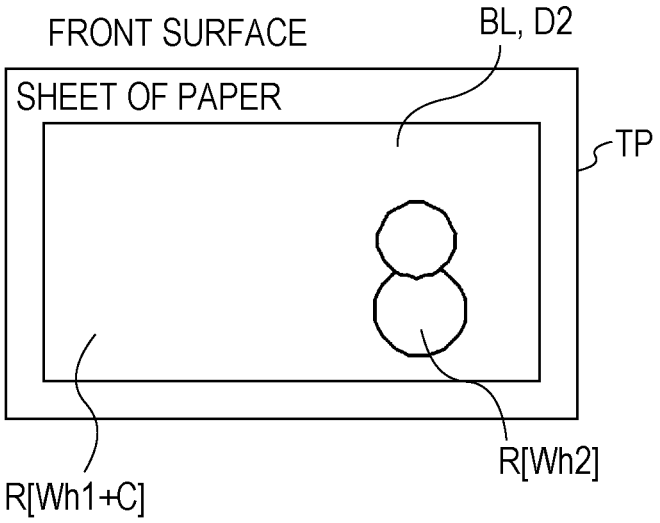
FIG. 11 is an illustrative diagram of a printing medium viewed from the front surface.

FIG. 11 is an illustrative diagram of the printing medium P viewed from the front surface. As shown in FIG. 11, the background region R[Wh1+C] and white region R[Wh2] can be seen on the front surface of the printing medium P. In other words, in the case of the rear printing mode also, as in the front printing mode, the white region R[Wh2] extracted from the first image data is formed without overlapping the background region R[Wh1+C]. In this way, it is possible to obtain a distinct white image because the white region R[Wh2] does not overlap the background region R[Wh1+C] and is not affected by the colors of the background region R[Wh1+C].

Furthermore, although white ink is discharged in the white region R[Wh2], the amount of white ink can be reduced because white ink is not discharged in the background region R[Wh1+C].

It should be noted that the invention is not restricted to the embodiment and can be implemented in a variety of forms as long as the implementation does not deviate from the essence of the invention, and, for example, the following variation is also possible.

In the embodiment, in the case the printing head is divided into first and second nozzle groups, the amount of white ink is controlled among the nozzle rows when the color image layer and background image layer are superimposed; however, it is also possible for the amount of metallic ink to be controlled as well as the amount of white ink.

In the embodiment, the printing head is divided into two nozzle groups; however, it is also possible for the printing head to be divided into three or more nozzle groups to thereby obtain a variety of printed material including many layers.

Furthermore, the amount of ink that is discharged from each nozzle row may be increased or decreased in consideration of the properties of each color when a plurality of layers are superimposed on one another. For example, when metallic ink is used as a special ink and a layer of white ink is superimposed on a layer of metallic ink, it is possible to perform control in such a way that the amount of white ink is reduced and the amount of color ink is not altered. Therefore, as a result of the light-blocking effect afforded by the metallic ink, the appearance is hardly affected even when the amount of white ink is reduced.

In the embodiment, a configuration is described in which the printing head is moved in the main scanning direction and the printing medium is moved in the sub-scanning direction; however, a form may also be implemented in which the printing head and printing medium move in a relative manner with, for example, the printing head moving in the sub-scanning direction with respect to the printing medium and the printing medium moving in the main scanning direction with respect to the printing head.

What is claimed is:

1. A printer for printing on a printing medium by moving a printing head, which discharges ink from a nozzle, and the printing medium in a relative manner in a main scanning direction and a sub-scanning direction which intersects the main scanning direction, the printer comprising:

a first nozzle group;

a second nozzle group which is located at the downstream side of the first nozzle group in the sub-scanning direction; and a control circuit for performing control to cause the ink to be discharged from the first nozzle group and the second nozzle group, the control circuit performing control to cause ink to be discharged from at least one of the first nozzle group and the second nozzle group based on both a portion of first image data which forms a color image layer representing an image and second image data that forms a background image layer, wherein, when ink having the same color is discharged from each of the first nozzle group and the second nozzle group in the same region of the printing medium, the control circuit performs control to cause ink to be discharged from the first nozzle group and the second nozzle group, on the basis of a determined correlation between the amount of ink to be discharged from the first nozzle group and the amount of ink to be discharged from the second nozzle group, and wherein the control circuit performs control, on the basis of the correlation, to reduce the amount of ink discharged from either one of the first nozzle group or the second nozzle group, such that the control circuit eliminates a portion of the first image data corresponding to the ejection of the ink to be ejected over an overlapping area of the background image where ink of a same color of ink is formed.

2. The printer according to claim 1, wherein the first image data is RGB data and the second image data is CMYK data.

3. The printer according to claim 1, wherein the printing head includes:

a color ink nozzle row in which nozzles for discharging color ink capable of forming the color image layer are arranged in the sub-scanning direction; and a special ink nozzle row in which nozzles that discharge special ink capable of forming the background image layer are arranged in the sub-scanning direction.

4. The printer according to claim 3, wherein the special ink is white ink.

5. The printer according to claim 3, wherein the special ink is metallic ink.

6. The printer according to claim 3, wherein the control circuit uses metallic ink as the special ink and performs control in such a way that the amount of white ink discharged onto the background image layer formed of the metallic ink is less than the amount of white ink discharged in a region in which the metallic ink is not present.

7. A printing method for causing ink to be discharged from a first nozzle group and a second nozzle group which is located at the downstream side of the first nozzle group in a predetermined direction, wherein the ink is discharged to form a color image layer representing an image and a background image superimposed onto the color image, the color image being formed on the basis of first image data and the background image being formed on the basis of second image data, the method comprising:

discharging ink from one of the first nozzle group and the second nozzle group based on both a portion of first image data and the second image data, wherein, when ink having the same color is discharged from each of the first nozzle group and the second nozzle group in the same region of a printing medium, the ink is caused to be discharged from the first nozzle group and the second nozzle group on the basis of a determined correlation between the amount of ink to be discharged from the first nozzle group and the amount of ink to be discharged from the second nozzle group, and wherein, on the basis of the correlation, the amount of ink discharged from either one of the first nozzle group or the second nozzle group is reduced by eliminating a portion of the first image data corresponding to the ejection of the ink to be ejected over an overlapping area of the background image where ink of a same color of ink is formed.

* * * * *